US007461750B2

(12) United States Patent
Armstrong

(10) Patent No.: US 7,461,750 B2
(45) Date of Patent: Dec. 9, 2008

(54) UNIVERSAL STORAGE SYSTEM FOR OFFICE TOOLS

(76) Inventor: Mark E. Armstrong, 2043 Skyway Valley, Hermon, ME (US) 04401

( * ) Notice: Subject to any disclaimer, the term of this patent is extended or adjusted under 35 U.S.C. 154(b) by 506 days.

(21) Appl. No.: 10/978,164

(22) Filed: Oct. 30, 2004

(65) Prior Publication Data

US 2005/0109717 A1 May 26, 2005

Related U.S. Application Data

(63) Continuation-in-part of application No. 10/692,710, filed on Oct. 23, 2003, now abandoned, and a continuation-in-part of application No. 10/615,578, filed on Jul. 8, 2003, now abandoned.

(51) Int. Cl.
*A47F 13/00* (2006.01)

(52) U.S. Cl. ..... 211/39

(58) Field of Classification Search ..... 211/39, 211/DIG. 1, 163, 70.6; 206/349; 248/206.5; 335/285

See application file for complete search history.

(56) References Cited

U.S. PATENT DOCUMENTS 475,120 A * 5/1892 Klingenberg ..... 211/39
3,314,634 A * 4/1967 Carter ..... 248/683
3,590,734 A * 7/1971 Carter ..... 101/23
4,183,439 A * 1/1980 Bell ..... 211/70.7
4,534,471 A * 8/1985 Zahn et al. ..... 211/39
5,437,376 A * 8/1995 Larsen ..... 211/40
5,669,516 A * 9/1997 Horn ..... 211/70.6
5,872,702 A * 2/1999 Kopel ..... 361/810
6,056,132 A * 5/2000 Becker et al. ..... 211/164
6,496,094 B2 * 12/2002 May, III ..... 335/285
6,614,337 B1 * 9/2003 Winnard ..... 335/285

* cited by examiner

*Primary Examiner*—Sarah Purol
(74) *Attorney, Agent, or Firm*—Anthony D. Pellegrini

(57) ABSTRACT

A universal storage system that includes a magnetic holding means and a universal storage device. The magnetic holding means is applied to or incorporated into an office stamp, tool, or other article, which is then stored on the universal storage device. The universal storage device includes a mounting surface of magnetically attractive material and securely holds the office stamp, tool, etc. in place, yet readily releases it when it is needed. The magnetic holding means is well-suited for mounting all types of conventional self-inking, flash inked, pre-inked, as well as wood-handled stamps, of any size, weight and shape, as well as other office and household articles and tools.

13 Claims, 5 Drawing Sheets

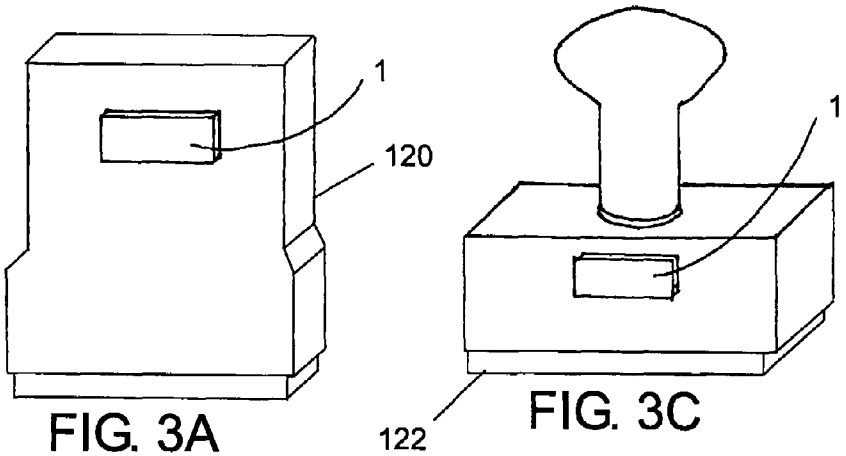
FIG. 3A
FIG. 3C
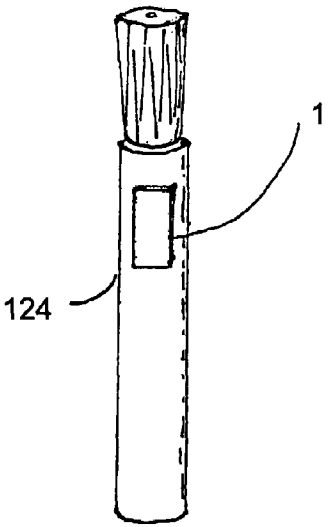
FIG. 3E
FIG. 3B
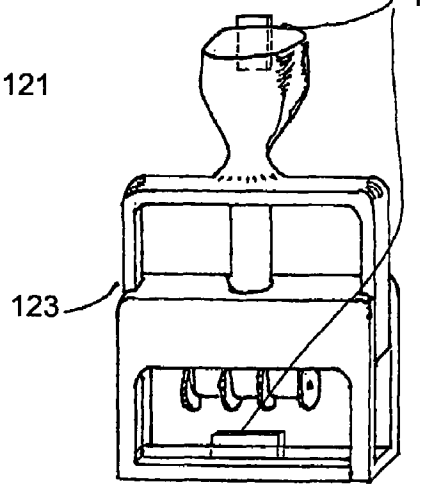
FIG. 3D
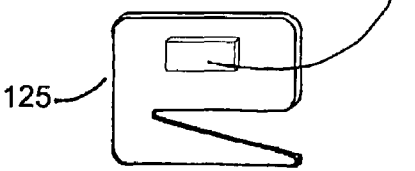
FIG. 3F

UNIVERSAL STORAGE SYSTEM FOR OFFICE TOOLS

BACKGROUND INFORMATION

1. Field of Invention

The invention relates to a system of organizing and storing office tools. More particularly, the invention relates to a system of magnetically storing and organizing office stamps and other tools.

2. Description of the Prior Art

Typically, when the term "stamp" or "rubber stamp" is used today to reference a marking device, it brings to mind a wood-handled rubber stamp that requires a remote pad in order to create an imprint. The majority of conventional holders for the storage of wood-handled stamps took advantage of the universal commonality in the wood handle shape and suspended the stamps from clips or hooks on racks. Another method of storage such wood-handled stamps used conventional magnets to mount the stamps on a stamp rack. One such method of storing wood-handled stamps with the use of a magnet is disclosed by Sinkiewicz (U.S. Pat. No. 2,996,004; 1961), in which a permanent magnet is imbedded into the rear of the wooden handle or fastened to a bracket of non-magnetic material, which is then fastened to the stamp between the handle and stamp base or to the stamp base proper by means of screws or the like. Carter (U.S. Pat. No. 3,314,634; 1967) disclosed a related method in which a removable strip of commonly available permanent magnetic material was applied to the rear of the stamp.

Both methods included the use of a storage holding strip that had magnetically attractive material applied to the face of the strip. The strip was typically fastened to a vertical surface by mechanical fasteners and the stamps held in place by the magnetic force exerted on the magnetically attractive material. These methods had a disadvantage in that only relatively lightweight wood-handled stamps can be mounted in this manner. This is because the permanent magnets that were available in the 1960s were low energy magnets. The magnets were also, of course, limited in size, because they had to fit on the wood-handled stamp, without interfering with its operation. Because the magnets were small and low energy products, the load they could reliably secure was correspondingly small.

Another variation of the magnetic methods described above was in the form of a "kit" which comprised a stamp pad mounted to a base and around which existed by means of a hinged arrangement the same magnetically attractive material formed into a type of cover that acted as a holding area for the stamps. This kit has the disadvantage of the other magnetic methods described above, but it also has the disadvantage of occupying valuable desk space, while storing relatively few stamps.

In the late 1960s, an "inked" type of stamp emerged onto the market place that combined the stamp and ink into a single unit, eliminating the need for an ink pad. Today, the market is almost exclusively dominated by such inked stamps, which include types of stamps that are referred to as "self-inking", "flash inked", "pre-inked", etc., although older wood-handled stamps remain in use. This shift from traditional wood-handled stamps to inked stamps created a need for a storage device capable of efficiently storing the various conventional types of stamps in use today.

The functional changes of the inked stamps resulted in changes to the conventional form, weight and construction materials used for office stamps. Most inked stamps have a bulky rectangular shape, without a handle from which to suspend the stamp from a rack. The self-inking type of inked stamps, for example, includes an inkpad within the stamp housing, and requires that the stamp rotate through an inking process before it is operational. Consequently, the stamp is significantly heavier and the stamp housing significantly larger than that of a wood-handled stamp that carries the same information. The known methods of magnetically holding office stamps were inadequate with regard to these inked stamps, primarily because the conventional magnetic materials were not strong enough to hold the new, heavier inked stamp.

Bertoni et al. (U.S. Pat. No. 6,510,951; 2003) discloses a stamp holder that is capable of holding a specific type of inked stamps, such as stamps having a box-like frame or case and openings on at least two opposite ends. A disadvantage of this stamp holder is its inability to hold other types of inked stamps, such as pre-inked or flash-ink stamps, older wood-handled stamps, or other office tools. Pichler (U.S. Pat. No. 6,003,686; 1999) discloses a device that holds the inked stamps, in addition to "other office utensils", by inserting "an attachment" in at least one of the through-holes provided in the base of the device. The "attachment" must be uniquely adapted for each different stamp or office utensil. In other words, each stamp or utensil mates with a particular holder. This is impractical and inefficient in terms of convenience, cost and/or time because this system locks one into using stamps and mating holders from a particular supplier or manufacturer, or requires that the user obtain custom-made attachments to hold stamps and/or utensils not provided with the mating holder. Furthermore, the base of the Pichler holder occupies more desk space than if the stamps and utensils were arranged neatly side by side on the desk, and because a stamp or utensil fits only into a mating holder, the Pichler system requires that the user locate the mating holder for a particular stamp or utensil in order to store it after use.

What is needed, therefore, is a system of organizing and storing office stamps and/or tools that is universal in its ability to hold such stamps or tools of various shapes, sizes, and weights, including a combination of any type of inked and wood-handled stamps. What is further needed is such a system that enables ready access to each stored office stamp and/or tool. What is yet further needed is such a system that occupies a minimum of desktop space and requires no installation tools to install it.

BRIEF SUMMARY OF THE INVENTION

For the reasons cited above, it is an object of this present invention to provide a universal system of storing and organizing conventional office stamps and/or tools of various weights, shapes, and sizes, including a combination of any type of inked stamp and wood-handled stamps. It is a further object to provide such a universal system that provides ready access to each stored office stamp and/or tool and ready replacement of such after its use. It is a yet further object to provide such a universal system that requires a minimum on desktop space and requires no installation tools.

The objects have been achieved by providing a universal storage system for storing and organizing office stamps and tools. The term "inked stamp" shall include various types of stamps that ink themselves, such as self-inking, flash, pre-inked, etc. The term "office stamps and tools", shall be abbreviated to "tools" and, as used hereinafter, shall include wood-handled stamps and various types of inked stamps, of various sizes, shapes and weights, as well as various conventional office tools and articles that are typically used at an office desk or workstation, such as markers, scissors, staplers, etc.

The purpose of the present invention is to improve storage efficiency of small office tools by using to advantage the vertical space that is available at a workstation. This is best achieved by using a magnet to mount the office tools to a magnetically attractive surface. The universal storage system according to the invention comprises a magnetic holding means and a universal storage device with a mounting surface of magnetically attractive material. The magnetic holding means includes a high-strength permanent magnet. A number of problems had to be resolved in order to achieve an efficient universal storage system that requires no work tools to set up and is inexpensive. The first problem to solve was the strength of the magnet. "First generation" permanent magnets that became available in the 1950s were made of ferrite or aluminum-nickel-cobalt (AlNiCo). These magnets had a relatively low "energy product", that is, the density of useful magnetic energy stored in the magnet was low. They provided sufficient holding strength to hold a conventional light-weight wood-handled stamp, but were not strong enough to hold a stamp or office tool that weighs, for example, one-half pound. Stronger "second generation" permanent magnets became available in the early 1980s, but were relatively expensive because of their use of rare-earth elements and were used primarily in military and aerospace applications. A "third generation" of permanent magnets was developed in 1983. These third generation magnets used less costly rare earth elements and were, therefore, less expensive, and they also had a very high energy product.

In addition to strength, other considerations for a suitable magnet for the universal storage device included the relative size of the magnet and is imperviousness to oil and dirt. The magnet must be attachable to a vast array of stamps and tools, thus, it must be relatively small and compact so that it does not interfere with the use or operation of the tool to which it is attached. The magnet should also last the lifetime of the tool to which it is attached and, therefore, must also be rugged and impervious to dust, dirt, oils, and other contaminants that are commonly present in work environments. One magnet that is particularly well-suited for use in the universal storage system is a neodymium-iron-boron (NdFeB) NEO 35 magnet having an energy product of max. 35 BH, and available from E.A. Magnetics Inc. of Bethpage, N.Y. Neodymium is highly corrosive, so the magnet has a protective nickel coating. Other sintered rare earth magnets, such as a Samarium Cobalt magnet are also suitable for use within the universal storage system.

In a first configuration of the magnetic holding means, the magnet is structurally integrated into the housing or outer surface of the tool In a second configuration, the magnetic holding means also comprises an adhesive means for attaching the magnet to an individual office tool. Ideally, the adhesive system provides a permanent bond to the protective nickel coating of the magnet, as well as to plastic and other materials commonly used in the manufacture of stamps, markers, letter openers and other common office tools. The adhesive means chosen is a double-coated acrylic foam tape that carries two dissimilar adhesives for bonding one side of the tape to the metallic surface of the magnet and the other to the plastic material of the tool to be mounted. A "medium surface energy" acrylic adhesive is applied to one side of the tape for adhering to the tool. This adhesive is particularly well-suited for adhering to the "hard-to-stick-to" thermoplastic materials typically used in the housings of the inked stamps. A "high surface energy" acrylic adhesive, particularly designed to adhere to metal surfaces, is applied to the other side of the foam tape, which side is applied to the magnet. The carrier for the adhesive is an acrylic foam tape that has the ability to conform to irregular shapes and curved contours, thereby providing maximum surface contact of the adhesive to the respective surface. The tape may also be provided in various shapes and sizes, to make it readily adaptable to the particular size and shape of the tool to which it is to be applied. Once applied to the respective surfaces, the adhesive means forms a stable long-term bond, that is able to withstand continuous shear stress over time without failure. An example of a suitable adhesive means is the 4622 VBH™ Double Coated Acrylic Foam Tape available from the 3M company. The adhesive sides of the tape are protected by a removable sheet until the adhesive tape is applied to a magnet and/or tool.

The universal storage device according to the invention comprises a mounting surface of magnetically-attractive material and encompasses numerous configurations. The magnetically-attractive material is typically a ferroalloy, referred to hereinafter as a ferrous material. In one configuration, the universal storage device is a structure with a plurality of panels, each of which is covered with a mounting surface that is a strip of ferrous material. In another configuration, the mounting surface of the universal storage device comprises a strip of ferrous material bonded to a desk mount holder. In yet another configuration, the mounting surface comprises a strip of ferrous material bonded to a panel that is mountable on a vertical surface, such as a fabric wall or a rigid wall.

The universal storage device provides a continuous mounting surface that is large relative to the objects that are typically stored on it. This relatively large surface allows the user to place all types of tools, including, but not limited to, round, rectangular, wood-handled, self-inking, pre-inked, and flash-inked stamps, as well as scissors, markers, and other miscellaneous tools, together on the same storage device, without having to seek a particular mating location. This allows the user to store and organize frequently used tools on the same storage device.

BRIEF DESCRIPTION OF THE DRAWINGS

The present invention is described with reference to the accompanying drawings. In the drawings, like reference numbers indicate identical or functionally similar elements.

FIG. 3A is an illustration of a conventional stamp that inks itself with a magnetic holding means applied.

FIG. 3B is an illustration of a conventional circular stamp that inks itself with a magnetic holding means applied.

FIG. 3C is an illustration of a conventional wooden handle stamp with a universal holding system applied.

FIG. 3D is an illustration of a conventional dieplate dating stamp that inks itself with magnetic holding means applied.

FIG. 3E is an illustration of a conventional marker with a magnetic holding means applied.

FIG. 3F is an illustration of a conventional letter opener with a magnetic holding means applied.

DETAILED DESCRIPTION OF THE INVENTION

Figure 2:
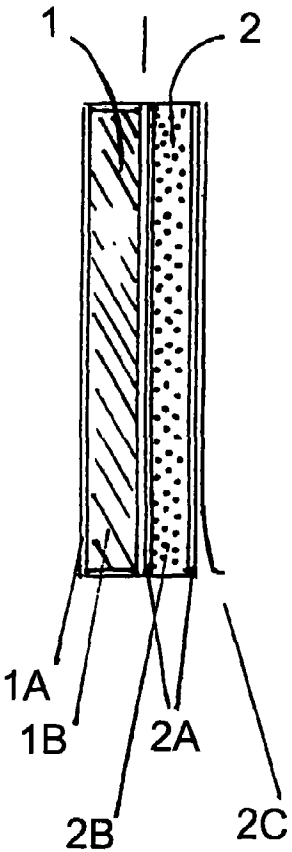
FIG. 2 is an enlarged detail side view of the magnetic holding means.
Figure 1:
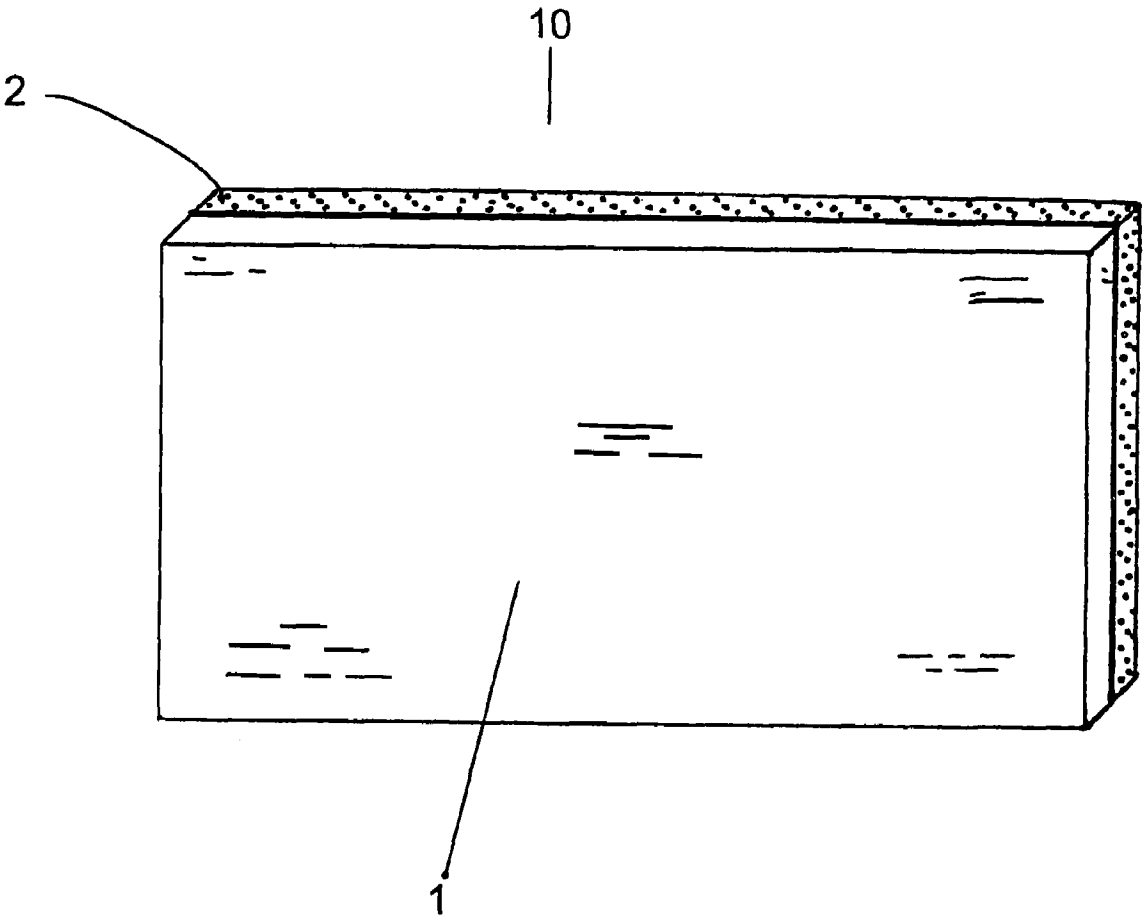
FIG. 1 is an enlarged view of the magnetic holding means.

FIGS. 1 and 2 illustrate perspective and side views of a magnetic holding means 10, which comprises two primary elements; a magnet 1 and an adhesive 2. FIG. 2 is a detailed sectional view of the magnetic holding means 10. The magnet 1 includes a core 1B, which is a high-strength rare-earth element magnet and, preferably, a neodymium-iron-boron magnet, surrounded by a nickel coating 1A. The adhesive 2 is a double-sided permanent bonding adhesive means comprising a bonding layer 2A on each of the two sides with a carrier material 2B sandwiched between the two bonding layers 2A. One bonding layer 2A has been applied to one of the surfaces of the magnet 1. The other bonding layer 2A is an exposed layer that is protected temporarily with a removable protective sheet 2C. An example of a suitable adhesive means is the 4622 VBH™ Double Coated Acrylic Foam Tape described above.

FIGS. 3A through 3F illustrate several different types of tools 119, i.e. stamps and other office tools, that have been adapted according to the invention for use with the universal storage system 10. These tools include various types of objects, of various weights, shapes, to which the magnetic holding means 10 has been attached. FIG. 3A represents a conventional rectangular inked stamp 120, including self-inking, flash, and pre-inked stamps, etc. that is of any shape, size or weight common to such inked stamps. FIG. 3B represents an odd shaped inked stamp 121, including self-inking, flash, pre-inked stamps, etc., that is of any shape, size or weight common to such inked stamps. FIG. 3C represents the conventional wood-handled stamp 122 that is of any shape, size or weight common to such stamps. FIG. 3D represents a conventional dieplate dater 123 that is of any shape, size or weight common to such daters. FIG. 3E represents a common office tool such as a high-lighter or marker 124 frequently used in an office setting.

FIG. 3F represents a common office tool such as a letter opener 125 that is used in an office setting.

Figure 4A:
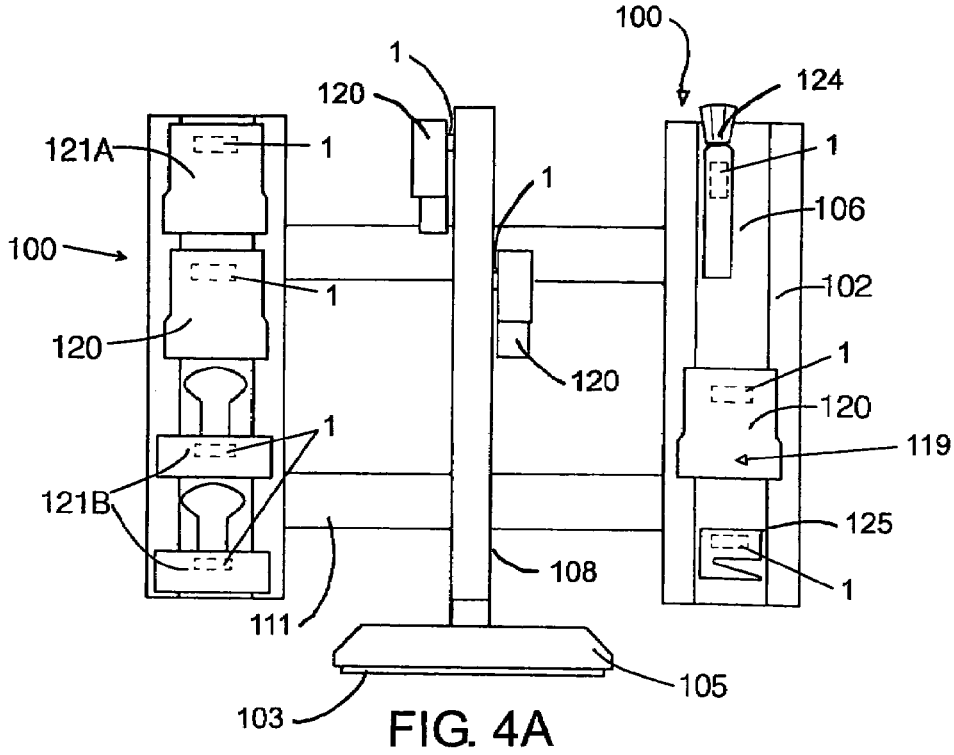
FIG. 4A is an elevational view of the first embodiment of the universal storage system according to the invention.
Figure 4B:
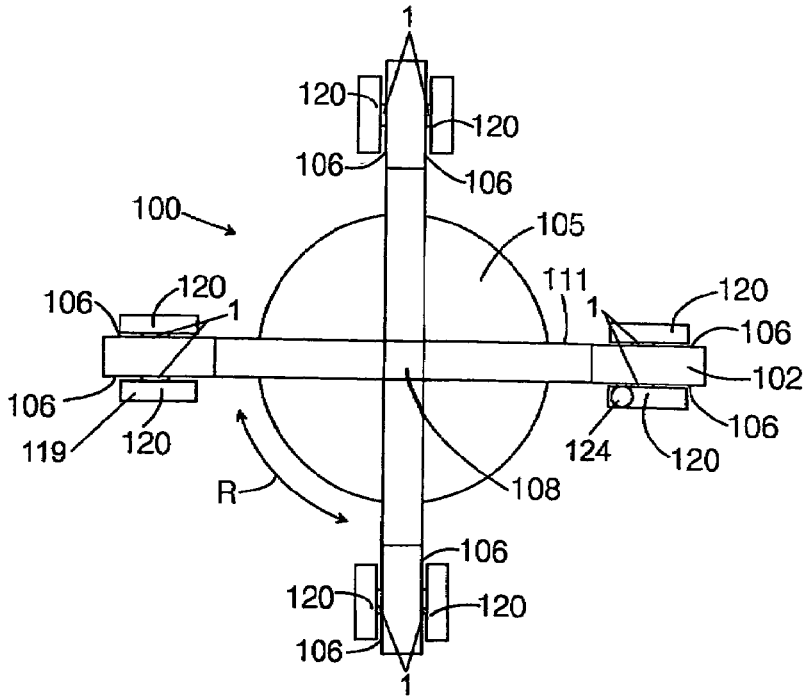
FIG. 4B is a top view of the system of FIG. 4A.

FIGS. 4A and 4B illustrate the first embodiment of a universal storage system 100 according to the invention, which is a rotary desk holder. FIG. 4A is an elevational view of the universal storage system 100, showing a plurality of holding panels 102 that are attached to and extend radially outward from a stem 108. The stem 108 is fastened to a base 105, which includes a suitable rotating plate or mechanism 103 that allows the stem 108 to rotate A mounting surface 106 is attached to opposite sides of each of the panels 102 to maximize storage efficiency. A collection of tools 119 is shown placed on each of the mounting surfaces 106 of the universal storage system 100. Each mounting surface 106 is ideally a strip of ferroalloy material that is permanently bonded to the panel 102. The magnetic holding means 10 (shown in dashed lines) has been applied to each tool 119 by simply peeling the protective sheet 2C away from the adhesive layer 2A and applying the magnetic holding means 10 to any suitable surface on the particular tool 119. Access to a particular tool 119 stored on the universal storage system 100 is quickly achieved by rotating the stem 108 until the desired tool is available. After using the chosen tool, it may then be returned quickly to the same location or any other available space on the universal storage system 100 that the user chooses, thus creating an efficient storage system.

Figure 5A:
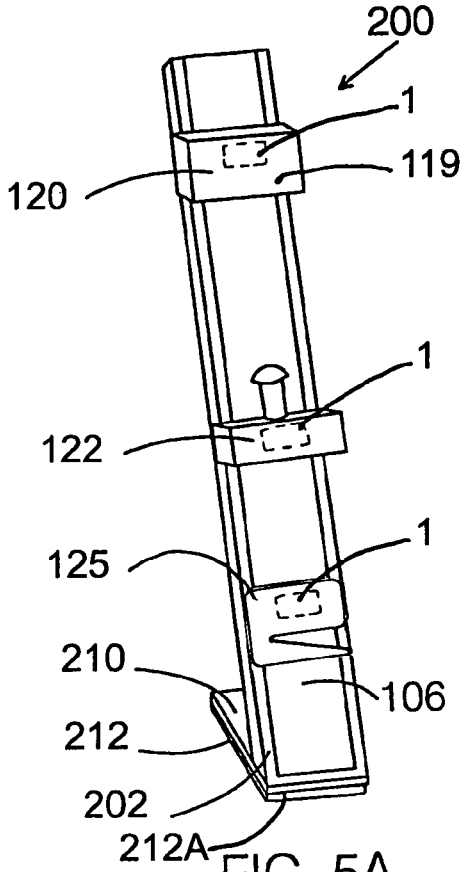
FIG. 5A is a perspective view of the second embodiment of the universal storage system.
Figure 5B:
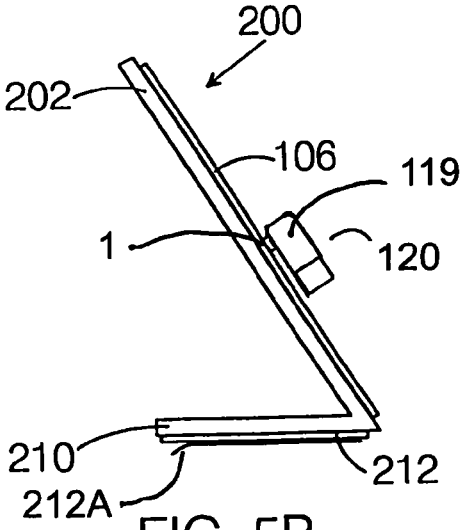
FIG. 5B is a side view of one variation the system of FIG. 5A.
Figure 5C:
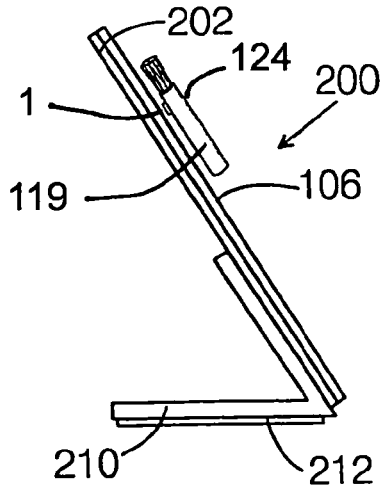
FIG. 5C is a side view of a second variation the system of FIG. 5A.

FIGS. 5A though 5C illustrate a second embodiment of a universal holding system 200 which is a desk-mount holder. As shown, a collection of tools 119 that have been adapted with the magnetic holding means 10 are stored on the mounting surface 106. The universal storage system 200 comprises a base 210 and a panel 202, which may be formed of a single piece of material, as shown in FIG. 5B, or be separate pieces that are fixedly attached to each other, as shown in FIG. 5C. The underside of the base 210 includes an anti slip adhesive 212 to prevent the universal storage system 200 from moving once positioned on the desired surface. The universal storage system 200 is easily installed on a desktop: the user simply applies the anti-slip means 212 to the desk or table surface, or to the underside of the base 210 and places the universal storage system 200 onto the desired surface. No tools are required to either install or remove the universal storage system 200. The anti-slip material 212 is preferably a material that remains flexible indefinitely and allow simple removal or repositioning at a later date by gently lifting on one end of the universal storage system 200 to cleanly lift the anti-slip material 212 from the surface. A suitable adhesive for this purpose is the Scotch Clear Mounting Squares, which is a removable adhesive.

Figure 6B:
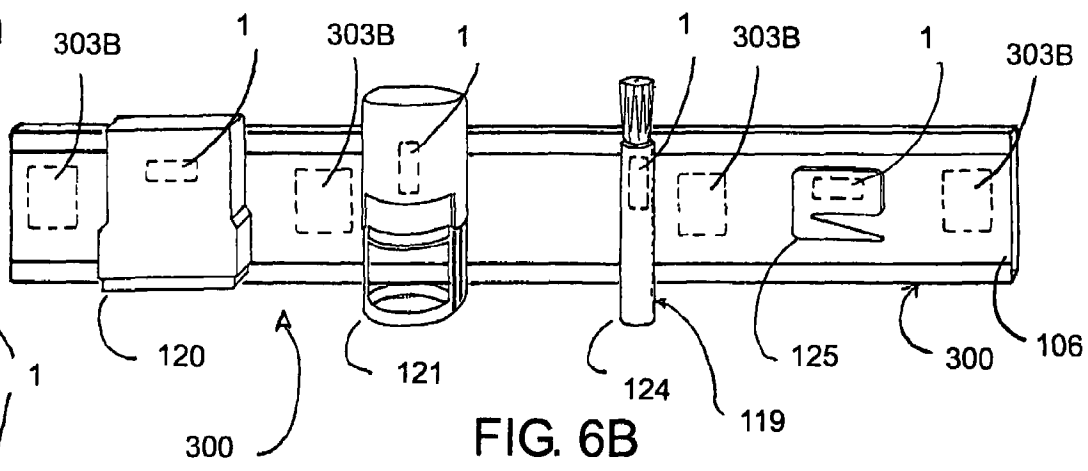
FIG. 6B is a perspective view of the third embodiment of the universal storage system mounted on a soft wall.
Figure 6A:
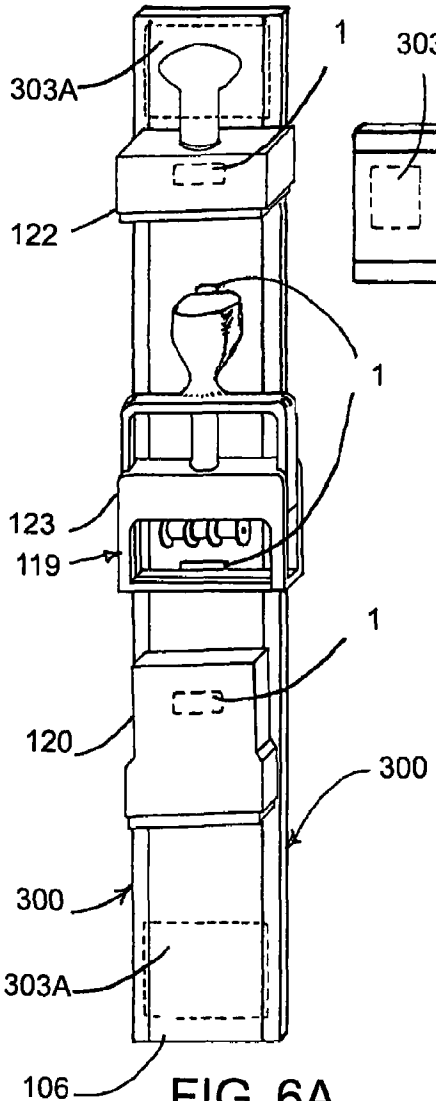
FIG. 6A is a perspective view of the third embodiment of the universal storage system mounted on a hard wall.

FIGS. 6A and 6B illustrate a third embodiment of a universal storage system 300, which is a universal wall mount holder for attaching to a hard wall or a soft (fabric) wall. FIG. 6A is a perspective view of the third embodiment of the universal storage system 300 shown storing several types of stamps 120,122,123 according to the invention. In this illustration, the universal storage system 300 is positioned vertically (although it could be mounted in any desired position) and shown configured for mounting on a hard wall surface with a fastener 303A. Ideally, the fastener 303A is a conventional adhesive means such as the COMMAND™ Removable Interlocking Fastener from 3M. Other types of adhesive patches or suitable fasteners, such as mating hook-and-loop type fabric fasteners that are adhesively affixed to the hard wall and to the back of the universal storage system 300 may also be used. Installation using these types of fasteners 303A does not require any tools or special skills.

FIG. 6B is a perspective view of the third embodiment of the universal storage system 300 shown mounted in a horizontal position and storing a collection of tools 119, including stamps 120,121 and common office tools 124,125 adapted according to the invention. In this illustration, the universal storage system 300 is mounted on a soft wall, such as on the wall of a partition commonly used in office environments. Soft wall fasteners 303B have been applied to the rear of the universal storage system 300, allowing the user to install the system 300 without the use of tools or special skills. These soft wall fasteners 303B are ideally a fastener, such as the commercially available 3M™ Scotch Cubicle Mounting Squares from 3M that is attached to the back of the universal storage system 300 and which anchors the system to the wall. To mount the universal storage system 300 to the soft wall, the user simply determines the desired location on the soft wall surface and then firmly pushes the universal storage system 300 against the surface in the desired position. The universal storage system 300 is removed by gently pulling it away from the soft wall until it fully separates. The mounting squares come away cleanly, leaving no marks. The wall type (hard or soft) determines which type of fasteners 303A or 303B are applied to the universal holding system 300.

It is understood that the embodiments described herein are merely illustrative of the present invention. One skilled in the art may contemplate variations in the construction of the invention without limiting the intended scope of the invention herein disclosed and as defined by the following claims.

What is claimed is:

1. A desk-mount storage system for office tools, said system comprising: a storage means having a magnetically attractive surface and further having a magnetically mountable office tool comprising an office tool having an outer surface constructed at least in part of a plastic material;

said office tool including a rare-earth-element magnet with holding power to support a load of at least eight ounces on a vertical surface, said rare-earth-element magnet having an outer surface constructed at least in part of a metallic material; and said office tool including an adhesive means for attaching said magnet to said office tool, said adhesive means being suitably adapted to provide a permanent bond simultaneously to both a metallic surface and to a plastic surface, said adhesive means comprising a double-coated acrylic foam tape having a first side and a second side, said tape carrying two dissimilar adhesives, with the adhesive for bonding the first side of the tape to the metallic outer surface of the magnet being a high surface energy acrylic adhesive designed to adhere to metal surfaces, and the adhesive for bonding the second side of the tape to the plastic outer surface of the office tool being a medium surface energy acrylic adhesive designed to adhere to plastic materials, with the adhesive means forming a stable long-term bond between the magnet and the office tool that is able to withstand continuous shear stress over time without failure, and with the double-coated acrylic foam tape being suitably adapted to conform to irregular shapes and curved contours.

2. A wall-mount storage system for office tools, said system comprising: a wall-mountable storage strip comprising a magnetically attractive surface, and said office tool of claim 1, wherein said storage strip is adaptable for mounting on a wall.

3. A storage rack for holding magnetic items, said storage rack comprising a base, a storage panel, and an anti-slip means; wherein said storage panel is a substantially flat panel having a magnetically attractive surface, wherein said storage panel is fixedly attached to said base and extends upward from said base at an angle between 45 degrees and 90 degrees, and wherein said anti-slip means is provided on a bottom surface of said base; wherein said magnetic items are one or more of said office tool of claim 1.

4. The storage rack of claim 3, wherein said base and said flat panel are constructed as a single piece of acrylic material, said anti-slip means is a double-sided adhesive means that is attached to said bottom surface of said base, with a first side of said adhesive means bonding with an underside of said base and a second side of said adhesive means being releasably adherable to a flat surface.

5. The system of claim 1, wherein said storage means is a desk mount holder having a base and an upwardly extending storage panel.

6. The system of claim 5, wherein said storage panel has a first side and a second side with said magnetically attractive surface applied to said first side and to said second side.

7. The system of claim 5, wherein said storage panel includes multiple storage panels.

8. The system of claim 5, wherein said storage panel is rotatably mounted on said base.

9. The system of claim 2, further comprising a wall-mounting means for mounting said storage strip on a wall.

10. The system of claim 9, wherein said wall is a fabric wall and said wall-mounting means is a fastener that releasably mounts said storage strip on said fabric wall.

11. The storage rack of claim 3, wherein said base and said flat panel are constructed as a single piece of acrylic material.

12. The storage rack of claim 11, wherein said anti-slip means is a double-sided adhesive means that is attached to said bottom surface of said base, a first side of said adhesive means bonding with an underside of said base and a second side of said adhesive means being releasably adherable to a flat surface.

13. The magnetically mountable office tool of claim 1, wherein said rare-earth-element magnet is a nickel-coated neodymium-iron-boron magnet with an energy product of at least 25 BH.

* * * * *